US005129213A

United States Patent [19]

Hatakeyama

[11] Patent Number: 5,129,213

[45] Date of Patent: Jul. 14, 1992

[54] APPARATUS AND PROCESS FOR PRODUCING VACUUM BLOOD COLLECTING TUBES

[75] Inventor: Toyohiko Hatakeyama, Hyogo, Japan

[73] Assignee: Sekisui Chemical Co., Ltd., Osaka, Japan

[21] Appl. No.: 765,777

[22] Filed: Sep. 26, 1991

[51] Int. Cl.[5] ..... B65B 3/14; B65B 31/02

[52] U.S. Cl. ..... 53/432; 53/471; 53/474; 53/111 RC; 53/510; 53/281

[58] Field of Search ..... 53/411, 432, 474, 471, 53/489, 88, 510, 111 RC, 281, 472

[56] References Cited

U.S. PATENT DOCUMENTS

| | | | |
|---|---|---|---|
| 1,828,864 | 10/1931 | Hopkins | 53/474 X |
| 3,274,747 | 9/1966 | Fueslein et al. | 53/432 |
| 3,332,788 | 7/1967 | Barnby | 53/510 X |
| 3,358,869 | 12/1967 | Palmer et al. | 53/432 X |
| 3,805,475 | 4/1974 | Glenn | 53/474 X |
| 4,295,974 | 10/1981 | Cornell | 53/474 X |
| 4,397,392 | 8/1983 | Runck et al. | 53/474 X |

*Primary Examiner*—Horace M. Culver

*Attorney, Agent, or Firm*—Armstrong, Nikaido, Marmelstein, Kubovcik & Murray

[57] ABSTRACT

An apparatus for producing vacuum blood collecting tubes comprises a pinhole checker for checking the bottom portion of each of bottomed tubular containers for pinholes, a sprayer for spraying a blood coagulant to the inner surface of the container, an injector for injecting a serum separating agent into the container, an evacuating-closing device for evacuating the interior of the container and applying a stopper to an opening of the container, and container transport devices between these components. The injector comprises a transport container of solid structure formed in a surface thereof with a plurality of bores for inserting tubular containers individually thereinto, a nozzle case having a plurality of serum separating agent injecting nozzles insertable into tubular containers individually, a device for moving the transport container and the nozzle case relative to each other to press the bored surface of the transport container and a nozzle providing surface of the case against each other, and a device for reducing the pressure of a space defined by the pressed surfaces of the transport container and the case.

2 Claims, 14 Drawing Sheets

APPARATUS AND PROCESS FOR PRODUCING VACUUM BLOOD COLLECTING TUBES

BACKGROUND OF THE INVENTION

The present invention relates to an apparatus and a process for producing vacuum blood collecting tubes, and more particularly to an apparatus and a process for preparing vacuum blood collecting tubes from tubular containers having an open end and a bottom by spraying a blood coagulant to the inner surface of each of the containers, injecting a serum separating agent into the bottom portion of the container, and closing the open end of the container with a stopper after evacuating the interior thereof.

Production of such vacuum blood collecting tubes requires the steps of checking the bottom portion of the tubular container for pinholes, spraying the blood coagulant to the inner surface of the container, injecting the serum separating agent into the bottom portion of the container, and closing the open end of the container after evacuating the interior thereof. Conventionally, these steps were performed individually.

Especially in the serum separting agent injecting step, the agent must be injected into the tubular container with the interior of the container held in a vacuum to prevent introduction of air thereinto. This presents extreme difficulty in automating the step.

SUMMARY OF THE INVENTION

The main object of the present invention is to provide an apparatus and a process for automatically producing vacuum blood collecting tubes from tubular containers having a bottom, and more particularly such apparatus and process wherein the step of injecting a serum separating agent into the containers can be automatically performed easily.

The apparatus of the present invention for producing vacuum blood collecting tubes from tubular containers having a bottom comprises a pinhole checker for checking the bottom portion of each of the containers for pinholes, a sprayer for spraying a blood coagulant to the inner surface of the tubular container, an injector for injecting a serum separating agent into the tubular container, an evacuating-closing device for evacuating the interior of the tubular container and applying a stopper to an opening of the tubular container, and container transport means between the components. The apparatus is characterized in that the injector comprises a transport container of solid structure formed in a surface thereof with a plurality of bores for inserting tubular containers individually thereinto, a nozzle case having a plurality of serum separating agent injecting nozzles insertable into tubular containers individually, means for moving the transport container and the nozzle case relative to each other to press the bored surface of the transport container and a nozzle providing surface of the nozzle case against each other, and means for reducing the pressure of a space defined by the pressed surfaces of the transport container and the nozzle case.

The process of the present invention for producing vacuum blood collecting tubes comprises the steps of checking the bottom portions of bottomed tubular containers for pinholes while holding the tubular containers approximately horizontal, spraying a blood coagulant to the inner surfaces of the tubular containers while holding the containers approximately horizontal, inserting the tubular containers having the blood coagulant sprayed to their inner surfaces individually into a plurality of bores formed in a surface of a transport container of solid structure, pressing a nozzle case having a plurality of serum separating agent injecting nozzles against the bored surface of the transport container relative thereto and injecting a serum separating agent into the tubular containers from the respective nozzles while reducing the pressure of a space defined by the nozzle case and the transport container, and evacuating the interior of the tubular containers and applying a stopper to an opening of each of the tubular containers.

The apparatus and process of the present invention are adapted to automatically prepare vacuum blood collecting tubes from tubular containers having a bottom. Especially, the step of injecting the serum separating agent into tubular containers can be automatically performed easily. More specifically, the transport container of solid structure has tubular container inserting bores formed in a surface thereof, which is pressed against the nozzle case to define a space separated off from the atmosphere. Since this space only can be reduced in pressure, the pressure-reducing space can be minimized and effectively separated off from the atmosphere. Consequently, a predetermined vacuum can be produced within a short period of time without using a pressure-reducing device of large capacity. Moreover, a plurality of tubular containers held in the transport container can be evacuated at the same time by a single pressure-reducing means, while the nozzle case is held out of direct contact with the tubular containers, which can therefore be evacuating with no influence exerted on the strength or accuracy of the ends of the tubular containers. Thus, the present apparatus is compact in its entirety and is nevertheless adapted to inject the serum separating agent into the tubular containers without incorporating bubbles into the agent.

Although preferred embodiments of the present invention will be described below with reference to the drawings, the apparatus and process of the invention are not limited to the embodiments.

DESCRIPTION OF THE PREFERRED EMBODIMENTS

Figure 1:
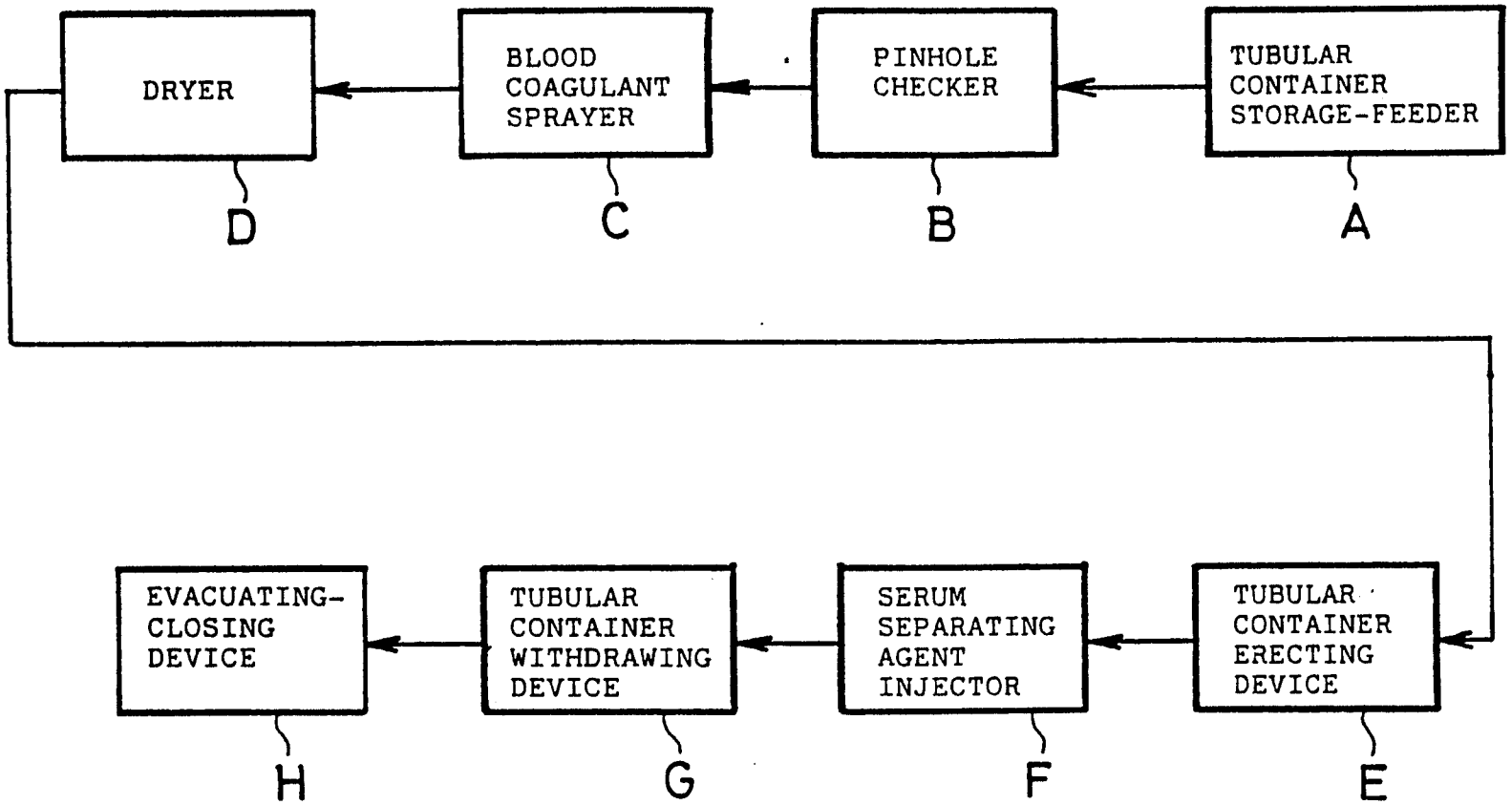
FIG. 1 is a diagram showing the overall construction of an apparatus embodying the present invention for producing vacuum blood collecting tubes.
Figure 2:
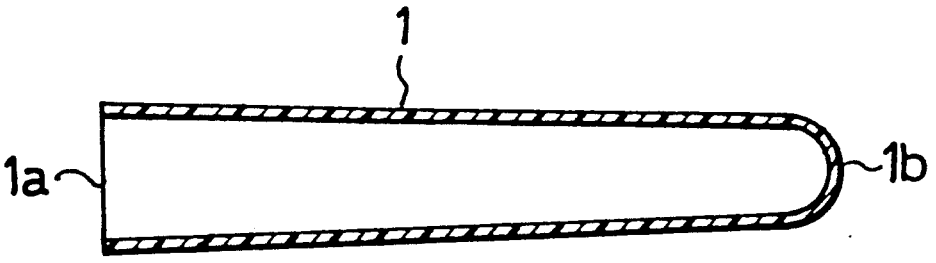
FIG. 2 is a view in longitudinal section showing a tubular container.
Figure 5:
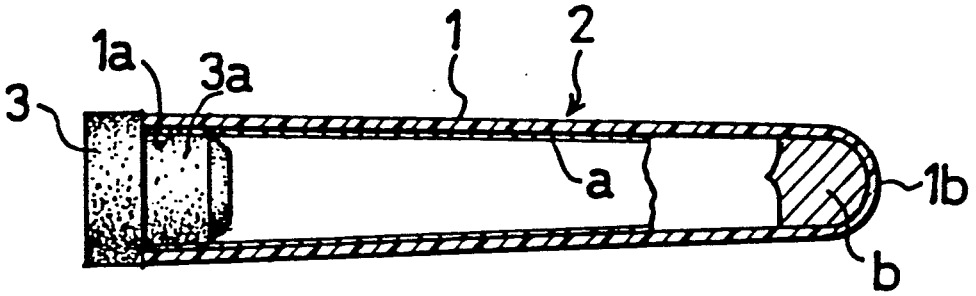
FIG. 5 is a view in longitudinal section showing the tubular container of FIG. 4 with a stopper fitted in an opening thereof, i.e., a completed vacuum blood collecting tube.

The apparatus shown in FIG. 1 for producing vacuum blood collecting tubes comprises a tubular container storage-feeder A, pinhole checker B, blood coagulant sprayer C, dryer D, tubular container erecting device E, serum separating agent injector F, tubular container withdrawing device G and evacuating-closing device H. The apparatus is adapted to produce vacuum blood collecting tubes 2 as shown in FIG. 5 from bottomed tubular containers 1 as shown in FIG. 2. The tubular container 1 is tapered and has an opening portion 1*a* and a bottom portion 1*b* smaller than the opening portion 1*a* in outside diameter. The vacuum blood collecting tube 2 as completed has a known blood coagulant a sprayed onto the inner surface of the tubular container 1, a known serum separating agent b injected into the bottom portion 1*b*, a stopper 3 applied to the opening portion 1*a* and a vacuum in its interior. The stopper 3, which is made of rubber, has a press-fit portion 3*a* providing one end, having a smaller diameter than the remaining portion and forced into the opening portion 1*a*.

Next, the construction of components of the apparatus will be described with reference to FIGS. 6 to 18. The terms "front," "rear," "right" and "left" will be used with respect to the direction of advance of the tubular container 1 through the components.

Figure 6:
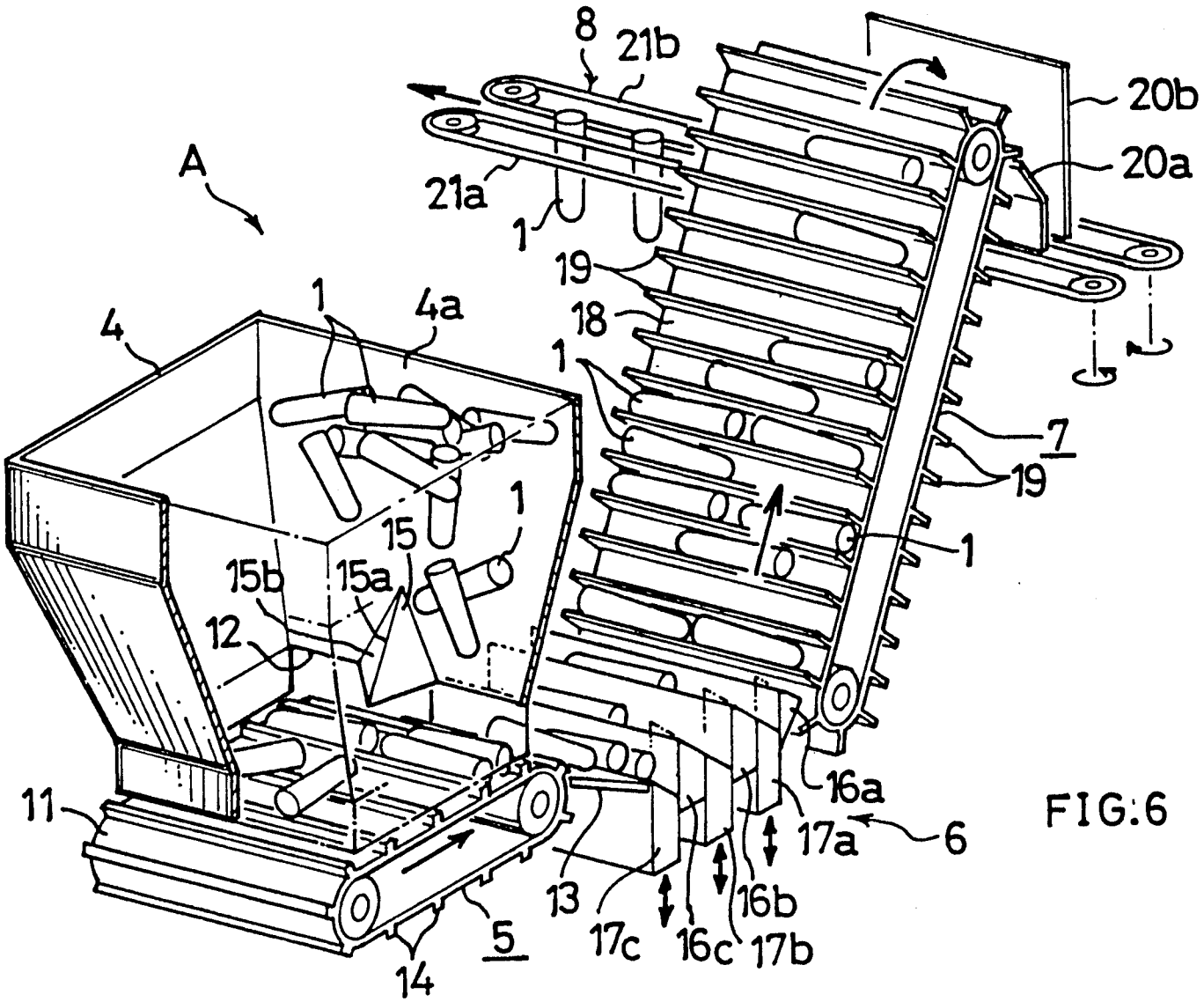
FIG. 6 is a perspective view showing part of a tubular container storage-feeder.
Figure 7:
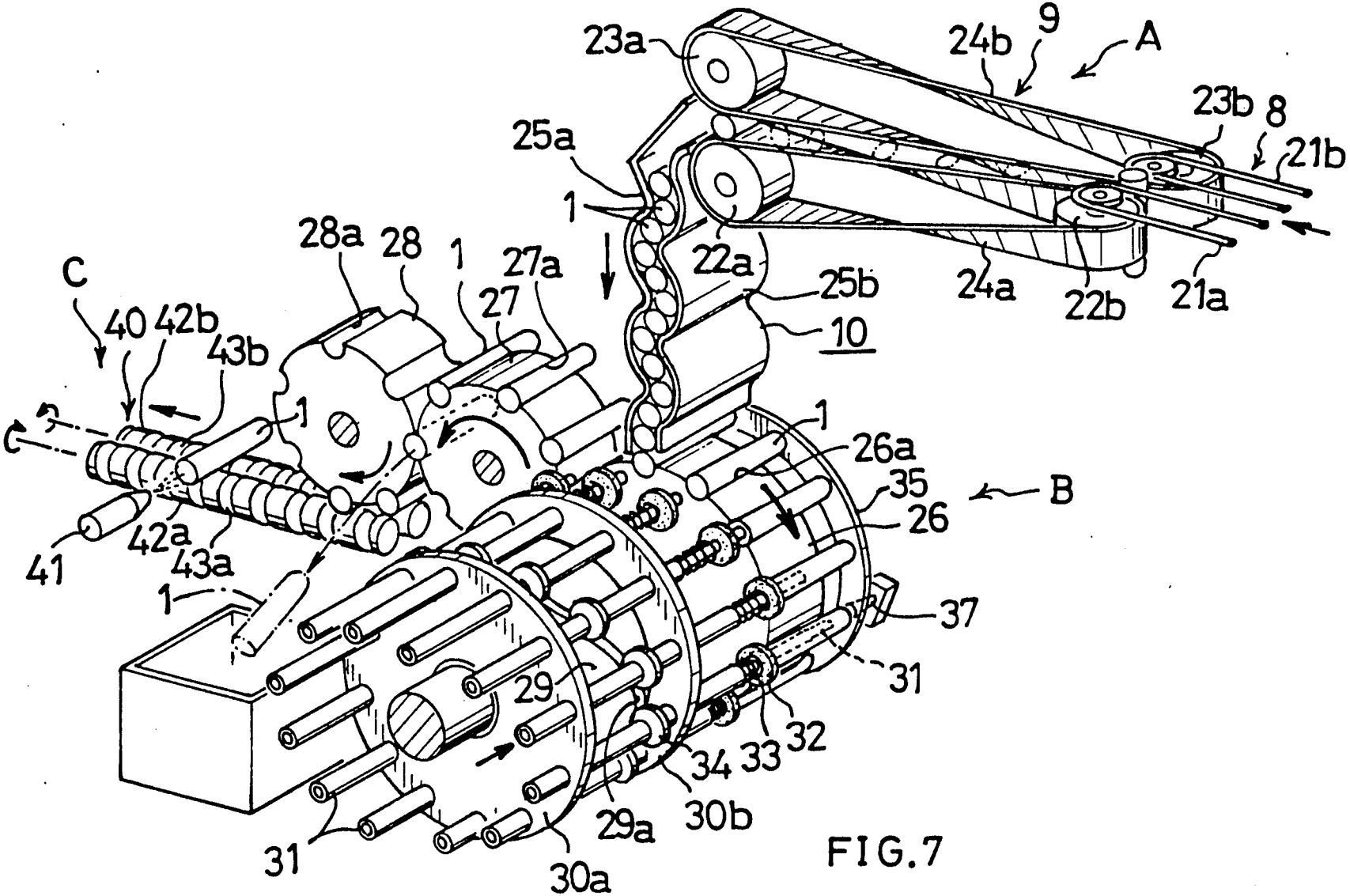
FIG. 7 is a perspective view showing part of the remainder of the storage-feeder, a pinhole checker and a blood coagulant sprayer.

The tubular container storage-feeder A is shown in FIGS. 6 and 7.

The device A is adapted to feed tubular containers 1 one by one, as positioned horizontally and oriented in a specified direction, to the pinhole checker B. The device A comprises a hopper 4, container delivery conveyor 5, lifter 6, lift conveyor 7, rope conveyor 8, twist belt conveyor 9 and wave-shaped chute 10.

As seen in FIG. 6, the delivery conveyor 5 has an endless belt 11 continuously driven by a pair of front and rear pulleys in the direction of arrow shown in FIG. 6, and is so disposed that the upper side portion of the belt 11 covers the lower-end opening of the hopper 4. The front wall 4*a* of the hopper 4 is cut out at its lower end to form a discharge opening 12 between the front wall and the belt 11 of the delivery conveyor 5. The front end of the delivery conveyor 5 is adjacent to rear end of a chute 13 in the form of a slanting plate and interposed between the conveyor 5 and the lifter 6. The belt 11 is formed on its outer surface with a plurality of relatively low projection plates 14 which are arranged side by side longitudinally of the belt at a spacing approximately equal to the outside diameter of the tubular container 1.

A guide member 15 is provided on the inner surface of the portion of the hopper front wall 4*a* defining the discharge opening 12. The guide member 15, which is made by bending a plate, has side edge portions extending from one end of a ridgeline 15*a* toward opposite sides thereof and joined to the inner surface of the front wall 4*a*. The ridgeline 15*a* extends obliquely rearwardly downward, and slopes 15*b* on opposite sides of the ridgeline extend downward while slanting toward the right and left.

The lifter 6 comprises three fixed members 16*a*, 16*b*, 16*c* and three lift members 17*a*, 17*b*, 17*c* which are arranged along the direction of transport of tubular containers 1. Each of the fixed members 16*a* to 16*c* and the lift members 17*a* to 17*c* has a slanting upper surface facing toward the front obliquely. The two lift members 17*a*, 17*b* toward the front are arranged between the three fixed members 16*a*, 16*b*, 16*c*, and the rearmost lift member 17*c* is interposed between the rearmost fixed member 16*c* and the chute 13. The three lift members 17*a* to 17*c* are moved upward and downward with a suitable period in a suitable order by suitable drive means.

The lift conveyor 7 has an endless belt 18 which is continuously driven by a pair of pulleys in the direction of arrow shown in FIG. 6. The belt 18 is formed on its outer surface with a plurality of relatively high projection plates 19 which are arranged side by side longitudinally of the belt at a spacing slightly larger than the largest outside diameter of the tubular container 1. The lift conveyor 7 obliquely extends forwardly upward from a position immediately in front of the lift 6 and has an upper end which is opposed to the upper portion of a space between a pair of guide plates 20*a*, 20*b* arranged between the conveyor 7 and the rope conveyor 8.

The rope conveyor 8 comprises a pair of left and right endless ropes 21*a*, 21*b* each of which is continuously driven by a pair of front and rear pulleys. The opposed portions of the pair of ropes 21*a*, 21*b* move forward as indicated by an arrow in FIG. 6. The opposed rope portions moving forward are spaced apart by a distance larger than the outside diameter of the bottom portion 1*b* of the tubular container 1 but smaller than that of the opening portion 1*a* thereof.

One of the guide plates, 20*a*, which is positioned between the upper end of the lift conveyor 7 and the rope conveyor 8 extends upward from the opposed portion rear part of the left rope 21*a*, is then inclined upwardly leftward and has an upper end which is positioned adjacent the upper end of the lift conveyor 7. The other guide plate 20*b* vertically extends upward from the opposed portion rear part of the right rope 21*b*. The distance between the lower ends of these guide plates 21*a*, 21*b* is slightly larger than the largest outside diameter of the tubular container 1.

With reference to FIG. 7, the twist conveyor 9 comprises a pair of twist belts 24*a*, 24*b* each continuously driven by a pair of front and rear pulleys 22*a*, 22*b* (23*a*, 23*b*). The rear pulleys 22*b*, 23*b* of the pair of belts 24*a*, 24*b* are arranged side by side and rotatable about their axes which are vertical. The front pulleys 22*a*, 23*a* are arranged one above the other and are rotatable about lateral horizontal axes. The forwardly moving portions of the belts 24*a*, 24*b* are twisted from a state in which they are opposed to each other laterally to a vertically opposed state.

The wave-shaped chute 10 comprises a pair of front and rear wave-shaped guide plates 25*a*, 25*b* which are spaced apart by a distance slightly larger than the largest outside diameter of the tubular container 1. The guide plates 25*a*, 25*b* have upper ends opposed to the front end of the twist conveyor 9 and lower ends to the pinhole checker B. The wave form of the guide plates 25*a*, 25*b* is continuously curved with a radius of curvature of about ⅓ of the length of the tubular container and has substantially no straight-line portion so as to prevent the diametrically small bottom portion 1*b* of each tubular container 1 from descending by a distance corresponding to the difference in outside diameter between the bottom portion 1*b* and the diametrically large opening portion 1*a* and from coming into contact with the bottom portion 1*b* of the preceding container 1. Although not shown, the guide plates 25*a*, 25*b* have a block plate at each of their right and left sides and a movable stopper at their lower ends.

Figure 11:
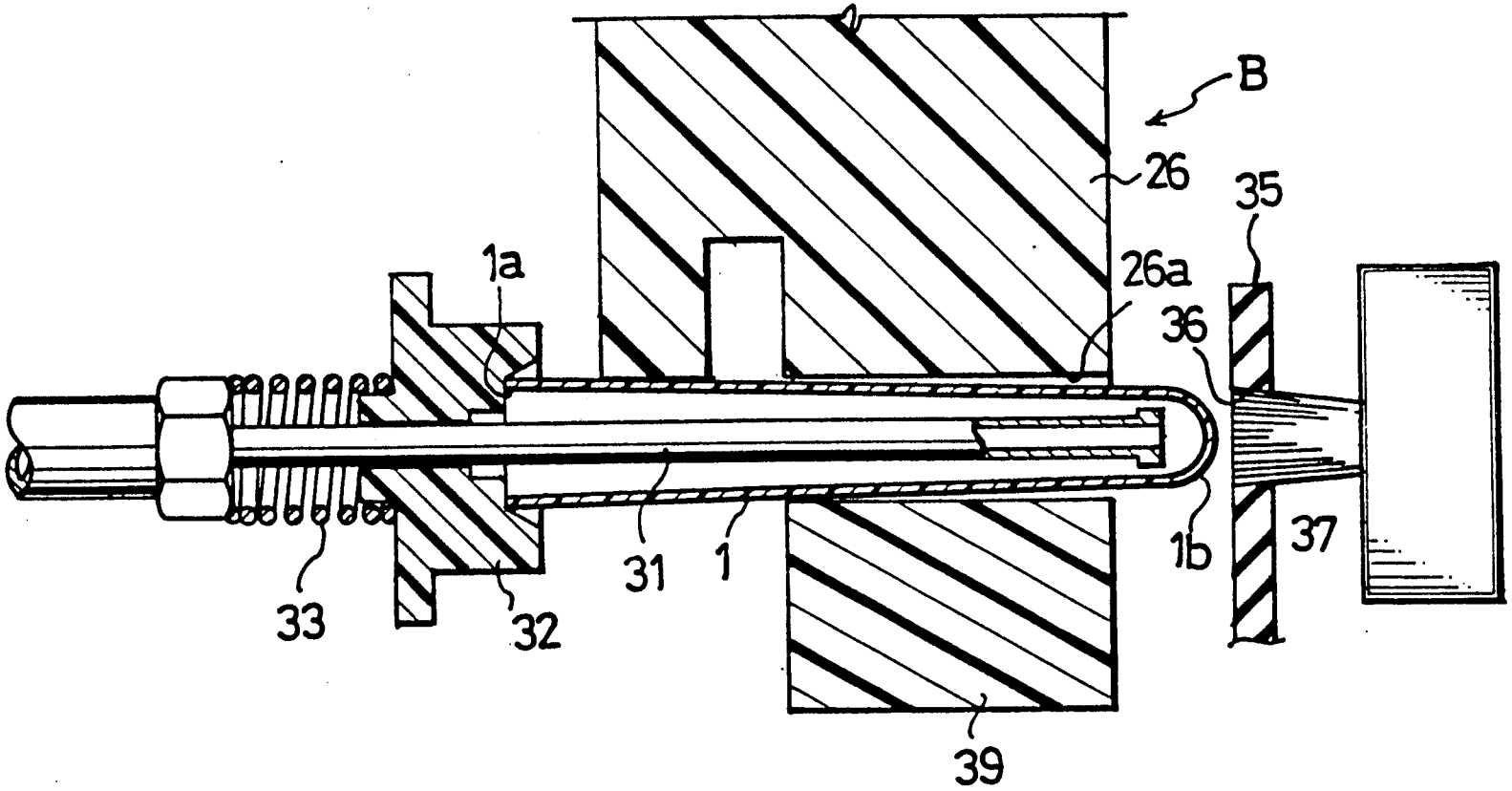
FIG. 11 is a fragmentary view in longitudinal section showing the pinhole checker.

The pinhole checker B is shown in FIG. 7, and the main components thereof in FIG. 11.

The checker B is adapted to check the bottom portion 1*b* of the tubular container 1 and the neighboring portion thereof for pinholes to exclude rejects. The device comprises three star wheels 26, 27, 28 respectively having container holding grooves 26*a*, 27*a*, 28*a* formed in the outer periphery at equal spacings. These star wheels 26, 27, 28 are driven, each in the the direction of arrow in FIG. 7, by suitable drive means in operative relation with one another intermittently by the pitch of grooves 26*a*, 27*a*, 28*a* at a time.

The lower end of the wave-shaped chute 10 is positioned immediately above the first star wheel 26. The front upward portion of the first star wheel 26 is positioned close to the rear downward portion of the second star wheel 27, and the front portion of the second star wheel 27 is adjacent to the rear portion of the third star wheel 28. The lower portion of the third star wheel 28 is opposed to the blood coagulant sprayer C.

At the left side of the first star wheel 26, a cam drum 29 concentric therewith is fixedly provided. A cam groove 29*a* is formed in the outer periphery of the drum 29. A pair of rotary disks 30*a*, 30*b* arranged respectively at the left and right sides of the cam drum 29 are concentric with the first star wheel 26 and rotatable therewith. Supported by these disks 30*a*, 30*b* are tubular electrodes 31 provided in corresponding relation with the holding grooves 26*a* of the first star wheel 26 and extending and movable axially of the wheel 26. Fitted around each tubular electrode 31 at a portion thereof close to its right end are a container pressing member 32 made of rubber and movable axially of the electrode and a coiled compression spring 33 for biasing the member 32 rightward. A cam follower 34 fixed to an intermediate portion of the tubular electrode 31 is fitted in the cam groove 29*a* of the cam drum 29. When the first star wheel 26 and the rotary disks 30*a*, 30*b* rotate, the engagement of the cam follower 34 in the cam groove 29*a* moves the tubular electrode 31 axially thereof, such that at the upper side of the arrangement close to the wave-shaped chute 10 and the second star wheel 27, the electrode 31 is moved to a left limit position where its right end is leftwardly away from the first star wheel 26, whereas at the lower side remotest from the chute 10 and the wheel 27, the electrode 31 is moved through the corresponding holding groove 26*a* of the first start wheel 26 to a right limit position to bring the electrode right end to the right side of the first star wheel 26.

An annular guide member 35 is fixedly provided on the right side of the first star wheel 26 for the tubular container 1 held in each groove 26*a* to bear thereon at its bottom portion 1*b*. An aperture 36 is formed in the guide member 35 at the portion thereof corresponding to the location where the tubular electrode 31 is to be moved to the right limit position. An electrode brush 37 is fixedly disposed at the right side of the aperture 36.

Although not shown, a reject discharge nozzle is disposed at the right side of the location where the second star wheel 27 is adjacent to the third star wheel 28.

Although not shown, each tubular electrode 31 has connected thereto an air supply-discharge device via a change-over valve, and a power supply. The three star wheels 26, 27, 28 are provided therearound with a guide member 39 cooperative with the holding grooves 26*a*, 27*a*, 28*a* for holding tubular containers 1 against slipping off.

Figure 12:
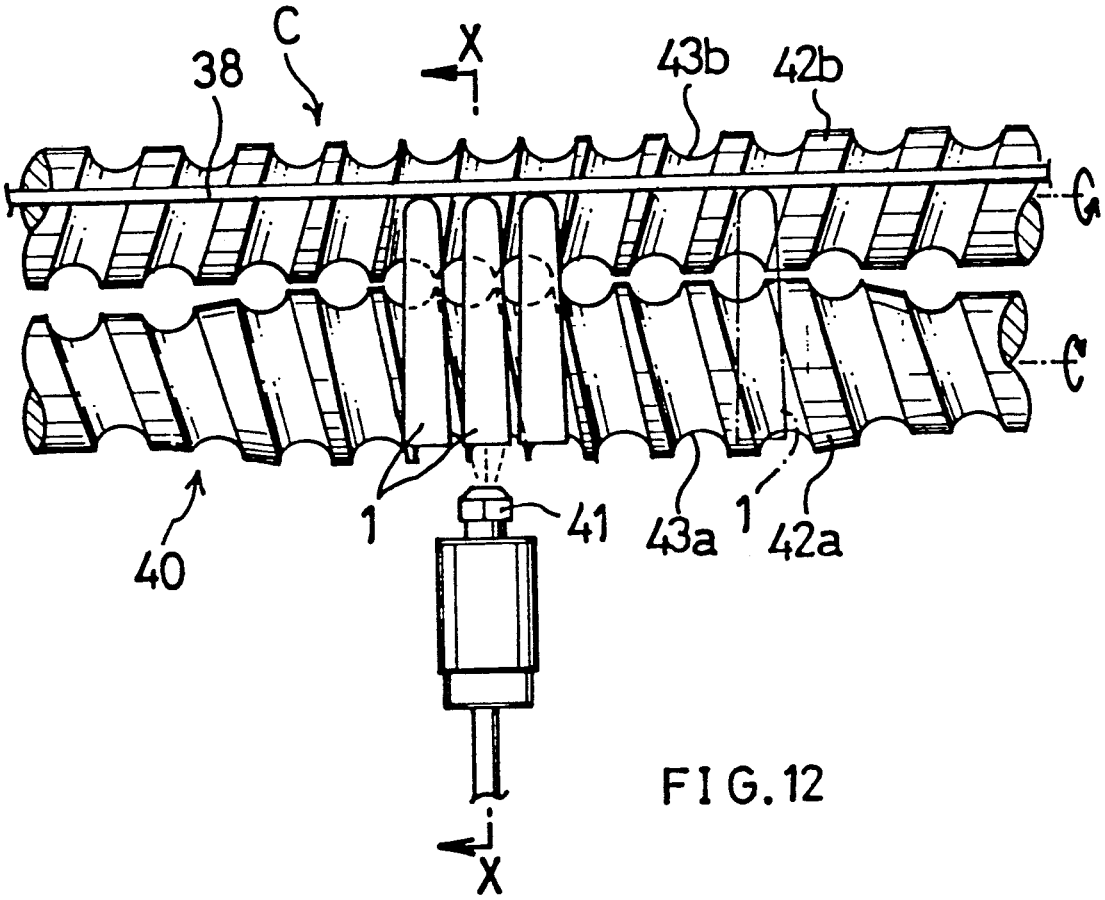
FIG. 12 is a fragmentary plan view showing the blood coagulant sprayer.
Figure 13:
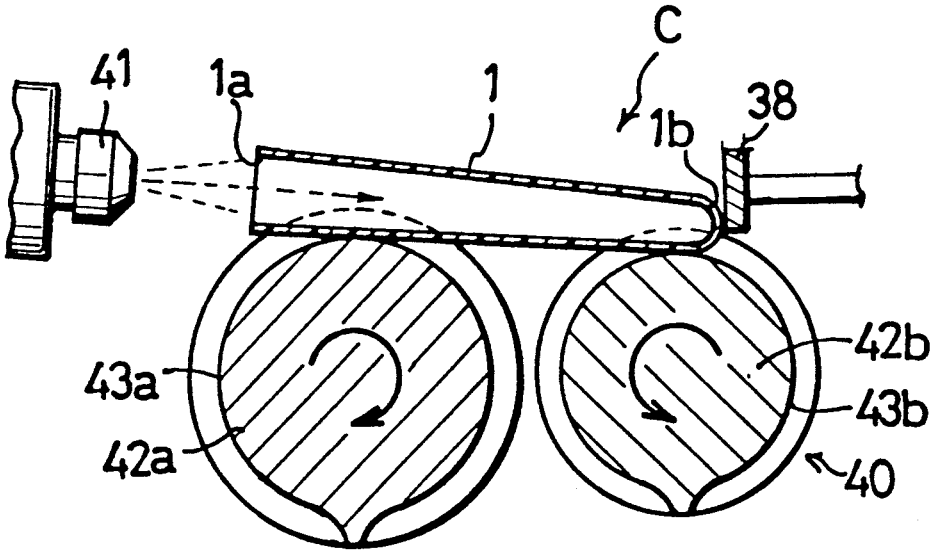
FIG. 13 is an enlarged view in section taken along the line X—X in FIG. 12.

The blood coagulant sprayer C is shown in FIG. 7, and the main components thereof in FIGS. 12 and 13.

The sprayer C applies the blood coagulant a to the inner surface of the tubular container 1 as shown in FIG. 2 and comprises a screw feeder 40 and a spray nozzle 41.

The screw feeder 40 comprises a pair of left and right screws rods 42*a*, 42*b* arranged horizontally in parallel to each other. The left screw rod 42*a* is slightly greater than the right screw rod 42*b* in outside diameter. The screw rods 42*a*, 42*b* are symmetrically formed in the outer periphery with furrows 43*a*, 43*b* semicircular in cross section and having a width approximately equal to the outside diameter of the tubular container 1 and a depth about one-half of the diameter for tubular containers 1 to fit in as positioned horizontally. The left screw rod 42*a* has a right-handed screw furrow 43*a*, and the right screw rod 42*b* has a left-handed screw furrow 43*b*. The pitch of these screw furrows 43*a*, 43*b* is smallest at the midportion of each screw rod and gradually increases from the midportion toward the front and rear ends of the screw rod. The screw furrows 43*a*, 43*b* have equal pitches at corresponding portions of the screw rods 42*a*, 42*b*. The furrow pitch at the midportion of each of the screw rods 42*a*, 42*b* is approximately equal to the outside diameter of the tubular container 1. The lower portion of the third star wheel 28 of the pinhole checker B is opposed to the rear end of the screw feeder 40.

The screw rods 42*a*, 42*b* are continuously driven by suitable drive means in the respective directions of arrows in FIGS. 7, 12 and 13. More specifically, the left screw rod 42*a* is rotated clockwise when seen from the rear, and the right screw 42*b* is rotated counterclockwise when seen from behind. A guide member 38 for guiding the bottom portions 1*b* of tubular containers 1 is disposed slightly above a rightward portion of the right screw rod 42*b*.

Although not shown, the nozzle 41 has connected thereto a pipe for supplying atomizing air, a pipe for supplying the blood coagulant a and a pipe for supplying operating air.

Figure 8:
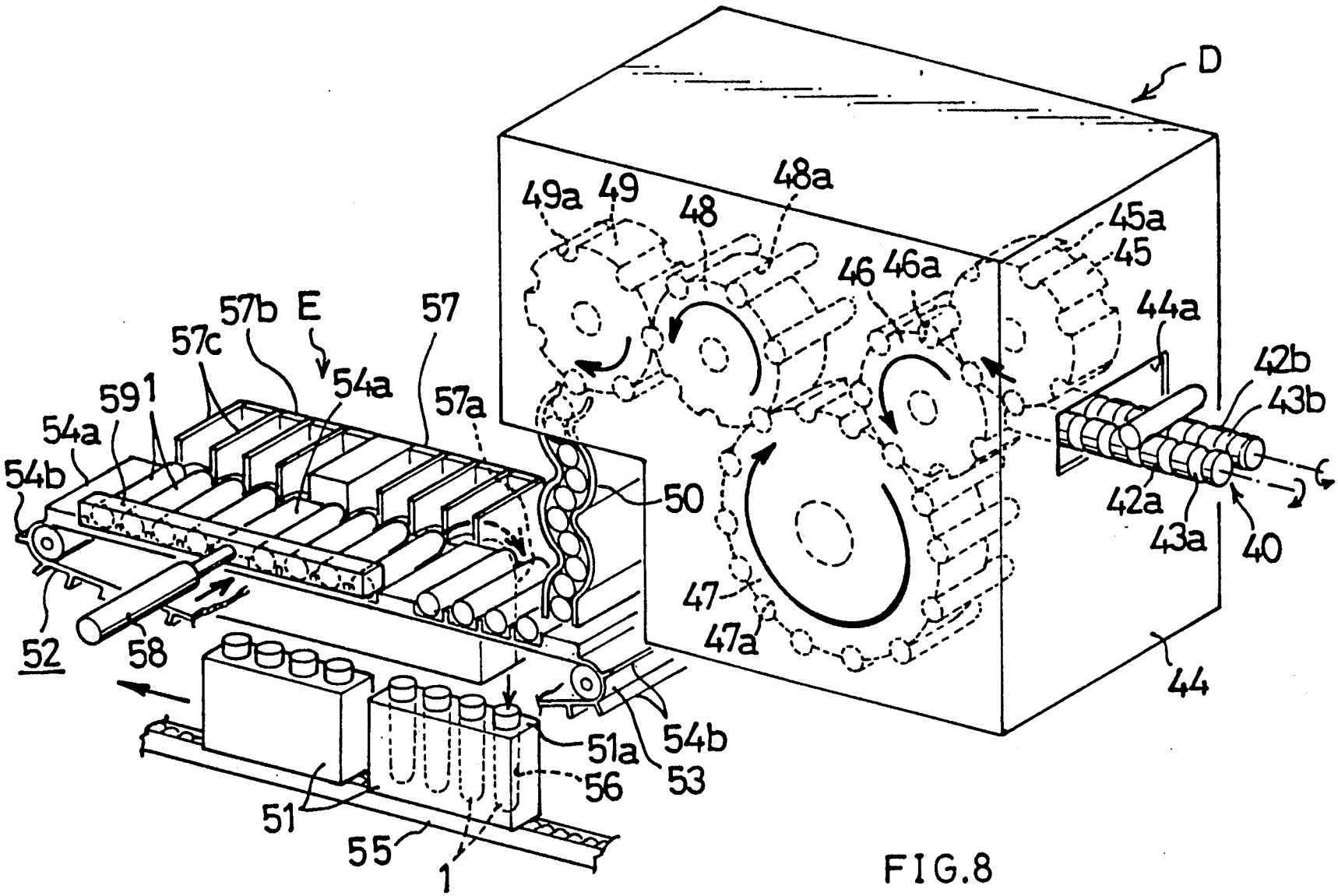
FIG. 8 is a perspective view showing a dryer and a tubular container erecting device.

The dryer D is shown in FIG. 8.

The dryer D has a drying chamber 44 for drying the tubular containers 1 having the blood coagulant a applied to the inner surface by passing the containers therethrough. The drying chamber 44 has inside thereof five star wheels 45, 46, 47, 48, 49 which are respectively formed with container holding grooves 45a, 46a, 47a, 48a, 49a in the outer periphery at equal spacings. The front portion of the screw feeder 40 of the sprayer C extends into the drying chamber 44 through an inlet opening 44a thereof. Inside the drying chamber 44, the lower portion of the first star wheel 45 is opposed to the front portion upper side of the screw feeder 40. The lower portion of the fifth star wheel 49 is positioned above the upper end of a wave-shaped chute 50 similar to the wave-shaped chute 10 previously described. These star wheels 45 to 49 are continuously driven in the respective directions of arrows shown in FIG. 8.

Figure 14:
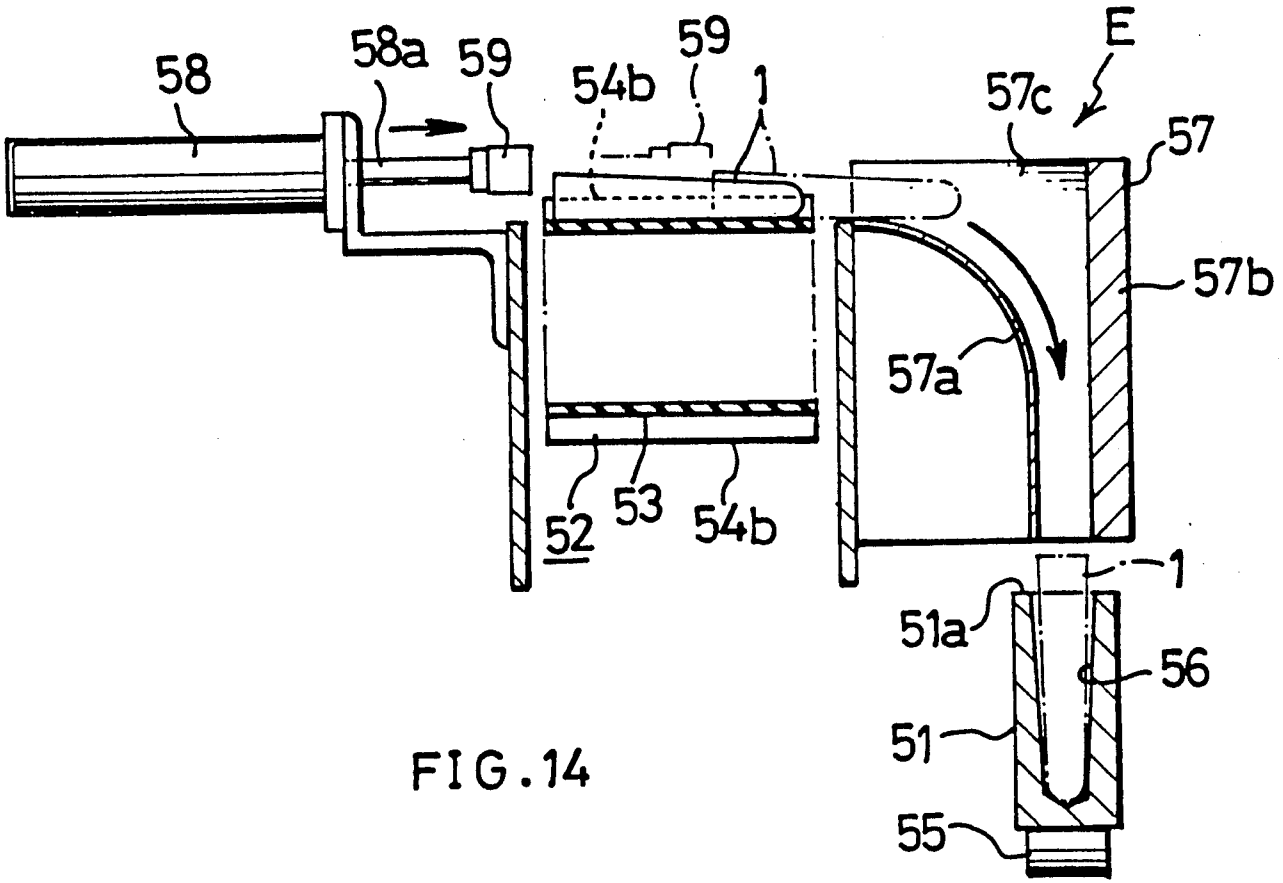
FIG. 14 is a fragmentary view in vertical section showing the erecting device.

The tubular container erecting device E is shown in FIG. 8, and the primary components thereof in FIG. 14.

The device E serves to place tubular containers 1 into transport containers 51, a group of containers 1 (four containers in the present embodiment) in each transport container 51, as positioned upright, and has the following construction.

A tubular container aligning conveyor 52 is disposed under the wave-shaped chute 50 and has an endless belt 53 which is intermittently driven by a pair of front and rear pulleys. The belt 53 is formed on its outer periphery with a plurality of projection plates 54a, 54b arranged side by side in the front-to-rear direction at a spacing approximately equal to the outside diameter of the tubular container 1. Every four projection plates, which are indicated at 54a, have a large width, while the three projection plates 54b between the plates 54a have a small width.

A transport container feed conveyor 55 is provided at the right side of and below the aligning conveyor 52. Transport containers 51 are intermittently sent forward in groups, two containers 51 in each group, by the conveyor 55. The transport container 51 is in the form of a solid rectangular parallelepiped and has in its upper surface a plurality of (e.g., four in the present embodiment) bores 56 for inserting tubular containers. The bores 56 have a depth slightly smaller than the length of the tubular container 1. The upper surface 51a of the transport container 51 formed with the bores is smooth.

At the right side of the tubular container aligning conveyor 52, a guide unit 57 is disposed above the transport container feed conveyor 55. The unit 57 comprises a first guide plate 57a extending upward from a position at the left side of the bores 56 of the transport container 51 on the feed conveyor 55 and then curved toward a position immediately adjacent to the right side of the aligning conveyor 52, a second guide plate 57b extending upward from a position at the right of the bores 56 of the transport container 51 on the feed conveyor 55, and nine partitions 57c provided between these guide plates and arranged in the front-to-rear direction.

Disposed at the left side of and above the aligning conveyor 52 is an air cylinder 58 oriented rightward and having a piston rod 58a which has fixed to its outer end a pusher 59 extending longitudinally of the conveyor 52. The pusher 59 is movable by the operation of the air cylinder 58 from a left limit position, leftwardly retracted from the aligning convyor 52, rightward above this conveyor 52 to a right limit position, and vice versa.

Figure 9:
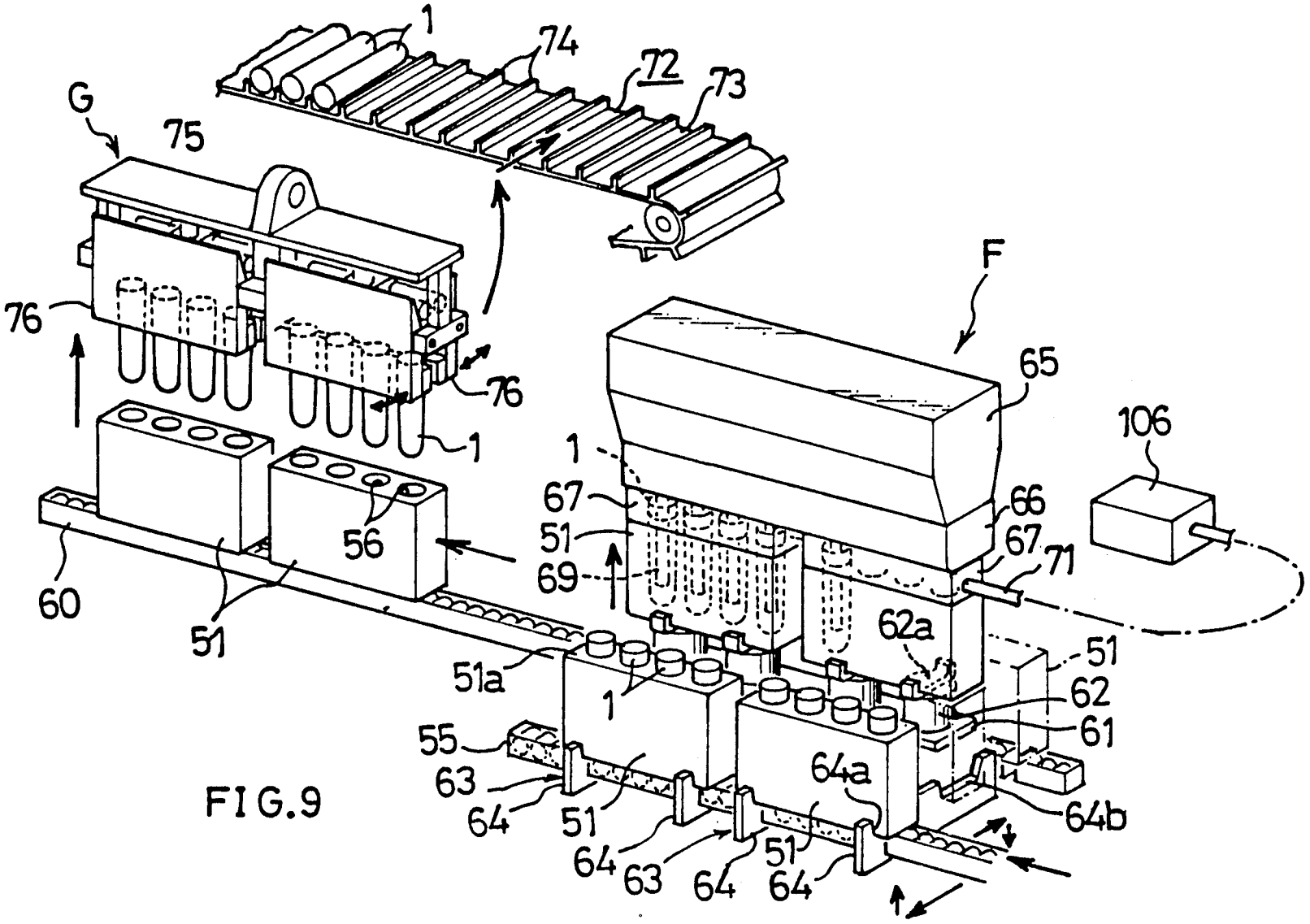
FIG. 9 is a perspective view showing a serum separating agent injector and a tubular container withdrawing device.
Figure 15:
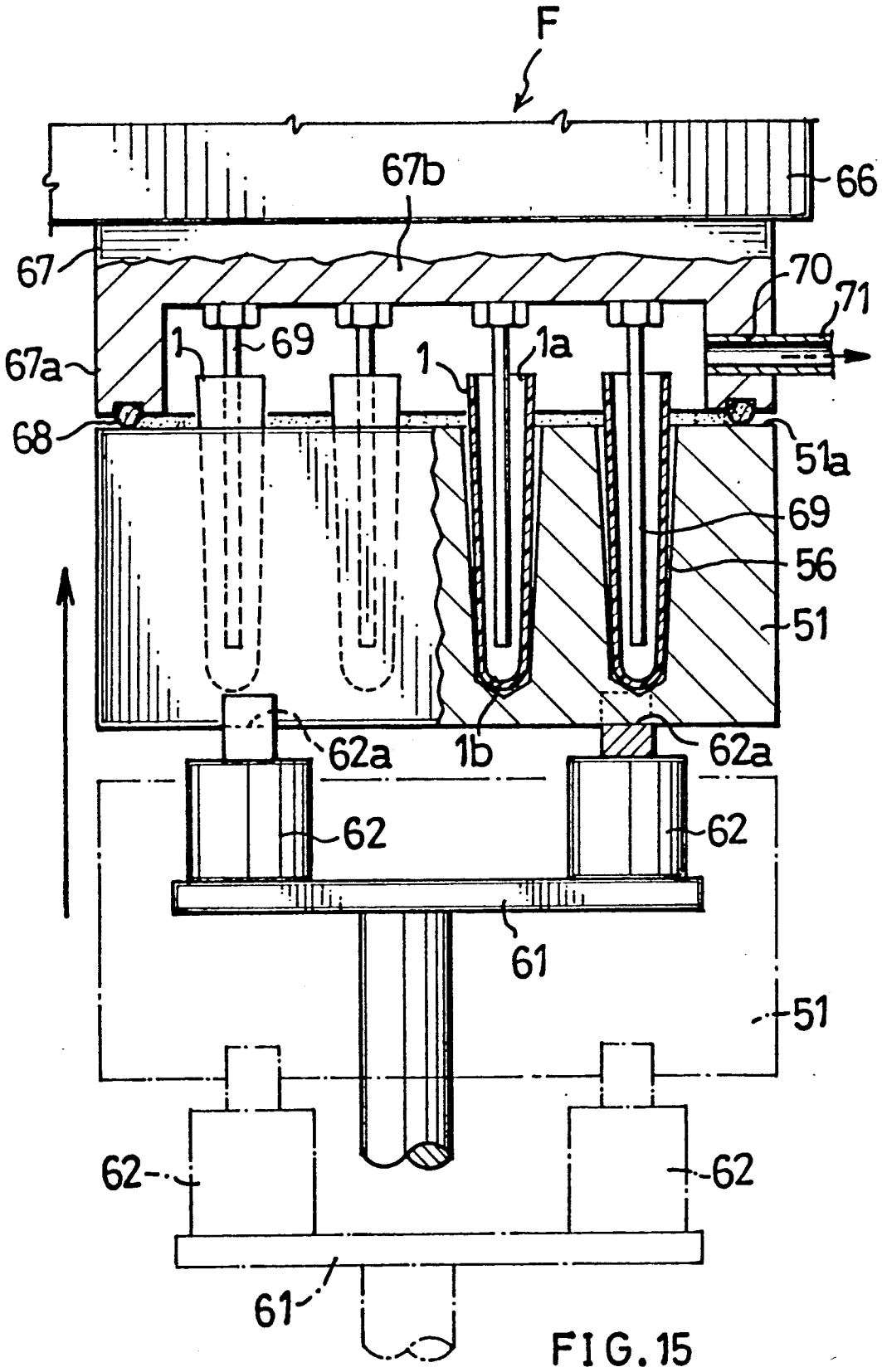
FIG. 15 is a fragmentary side elevation partly broken away and showing the injector.

The serum separating agent injector F is shown in FIG. 9, and the primary components thereof in FIG. 15.

Figure 3:
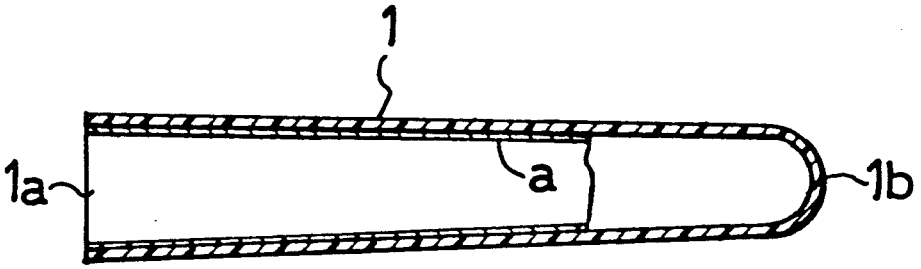
FIG. 3 is a view in longitudinal section showing the tubular container of FIG. 1 with a blood coagulant sprayed to the inner surface thereof.
Figure 4:
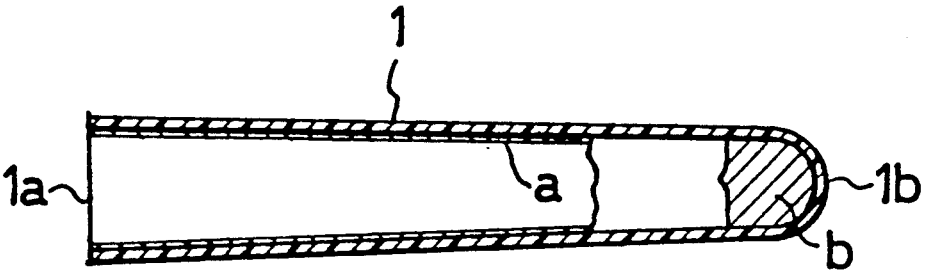
FIG. 4 is a view in longitudinal section showing the tubular container of FIG. 3 with a serum separating agent injected into the bottom portion thereof.

The injector F serves to inject the serum separating agent b into the bottom portion of the tubular container 1 as shown in FIG. 3 after the blood coagulant a has been applied to the inner surface thereof. The injector F has the following construction.

At the right side of the transport container feed conveyor 55 included in the tubular container erecting device E, a transport container delivery conveyor 60 is provided which is similar to the conveyor 55. The delivery conveyor 60 has a rear portion positioned in parallel to the right side of front portion of the feed conveyor 55. Front and rear two lift tables 61 are arranged between these portions. Mounted on each of the lift tables 61 are front and rear two supports 62 each formed with a transport container holding groove 62a. Front and rear two transport container transfer devices 63 each comprising a pair of front and rear vertical platelike movable members 64 are arranged between the feed conveyor 55 and the delivery conveyor 60. Each movable member 64 has a pair of left and right transport container holding grooves 64a, 64b and is movable upward, downward, leftward and rightward by suitable drive means. To avoid interference with the movable members 64, the feed conveyor 55 and the delivery conveyor 60 are cut out at the locations of the movable members 64. Each of the lift tables 61 is interposed between the front and rear movable members 64 and moved upward and downward by suitable drive means.

A serum separating agent tank 65 is disposed above the front and rear lift tables 61 and has fixed to its bottom a pair of front and rear nozzle cases 67, with a change-over valve unit 66 interposed therebetween. The nozzle case 67 has a peripheral wall 67a which is rectangular when seen from above and generally in conformity with the contour of the transport container 51 as seen from above, and a ceiling 67b integral with the peripheral wall 67a. The entire case 67 is in the form of an inverted channel in section. The lower surface of the nozzle case peripheral wall 67a is provided with a seal member such as an O-ring 68. Extending downward from the ceiling 67b of the nozzle case 67 are a plurality of (four in this case) front to rear serum separating agent injecting nozzles 69 in communication with an unillustrated change-over valve within the valve unit 66. An air supply-discharge port 70 extends through the peripheral wall 67a for holding the interior of the nozzle case 67 in communication with the outside, and communicates with pressure reducing means 106 having an unillustrated vacuum pump, etc.

The tubular container withdrawing device G is shown in FIG. 9.

The device G is adapted to withdraw tubular containers 1 from two transport containers 51 on the delivery conveyor 60 and place the tubular containers 1 as positioned horizontally on a tubular container conveyor 72.

Figure 10:
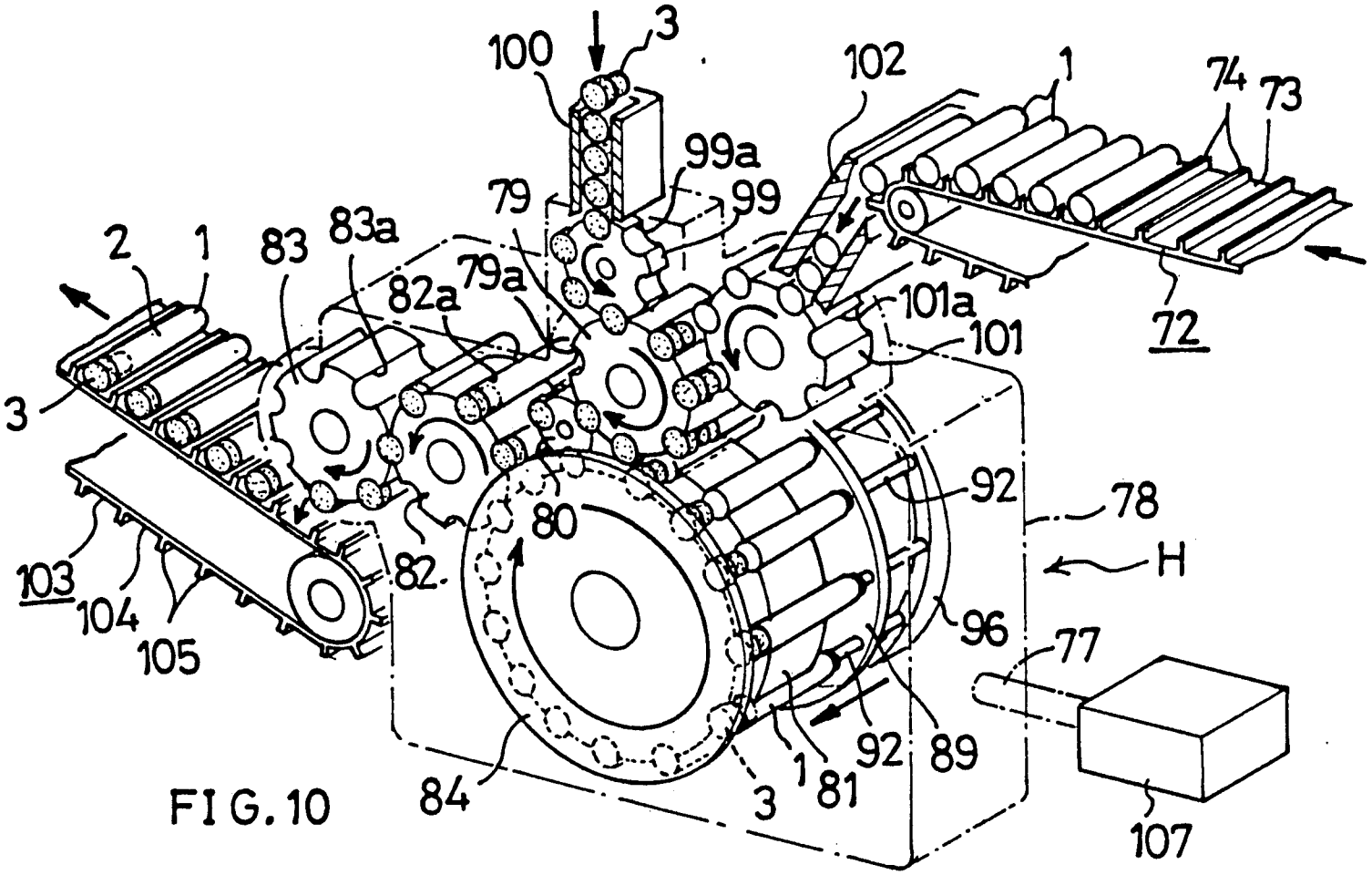
FIG. 10 is a perspective view showing an evacuating-closing device.

The conveyor 72 is disposed at the right side of the delivery conveyor 60 thereabove and has a rear portion positioned in parallel to the front portion of the delivery conveyor 60. The container conveyor 72 has an endless belt 73 which is intermittently driven by a pair of front and rear pulleys. The belt 73 has on its outer periphery a plurality of projection plates 74 arranged in parallel longitudinally of the conveyor 72 at a spacing approximately equal to the outside diameter of the tubular container 1. As seen in FIG. 10, the front end of the container conveyor 72 is positioned above the evacuating-closing device H.

The withdrawing device G includes a movable member 75 which is disposed between a position above the front portion of the delivery conveyor 60 and the rear portion left side of the container conveyor 72 and which is movable upward, downward, rightward and leftward and pivotally movable about an axis extending in the front-to-rear direction. The movable member 75 has a pair of front and rear grippers 76, between which a pusher is provided although not shown.

Figure 16:
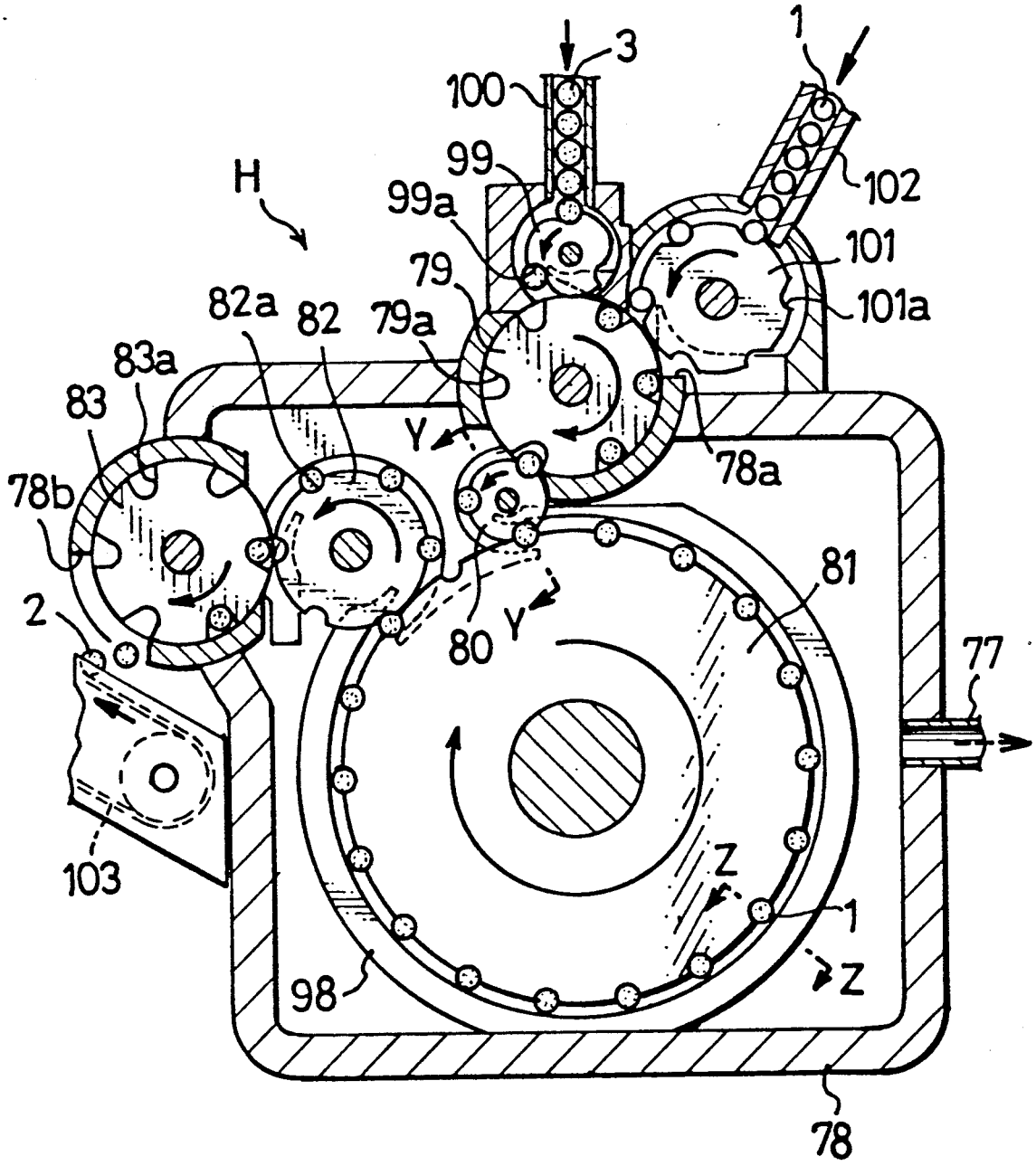
FIG. 16 is a fragmentary view in cross section of the evacuating-closing device.
Figure 17:
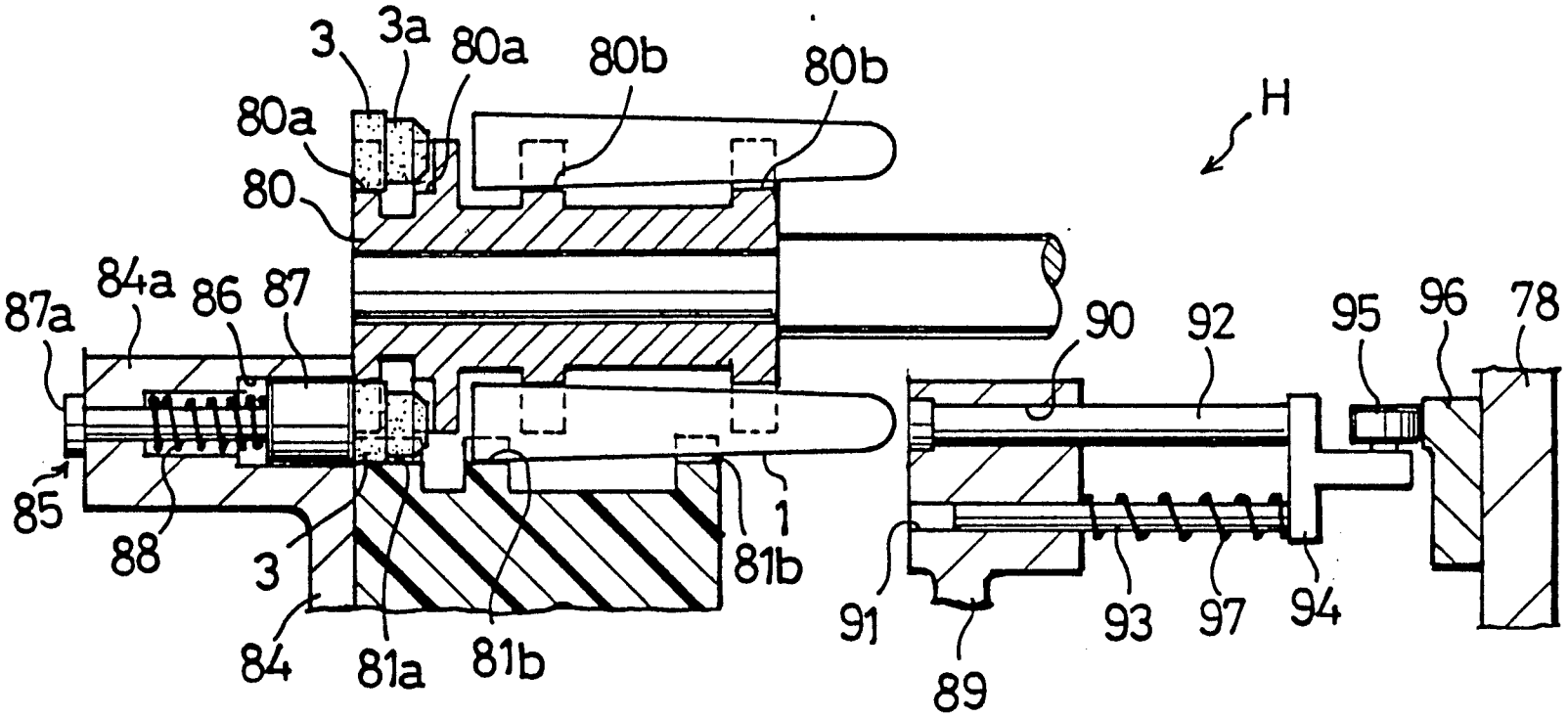
FIG. 17 is an enlarged view in section taken along the line Y—Y in FIG. 16.
Figure 18:
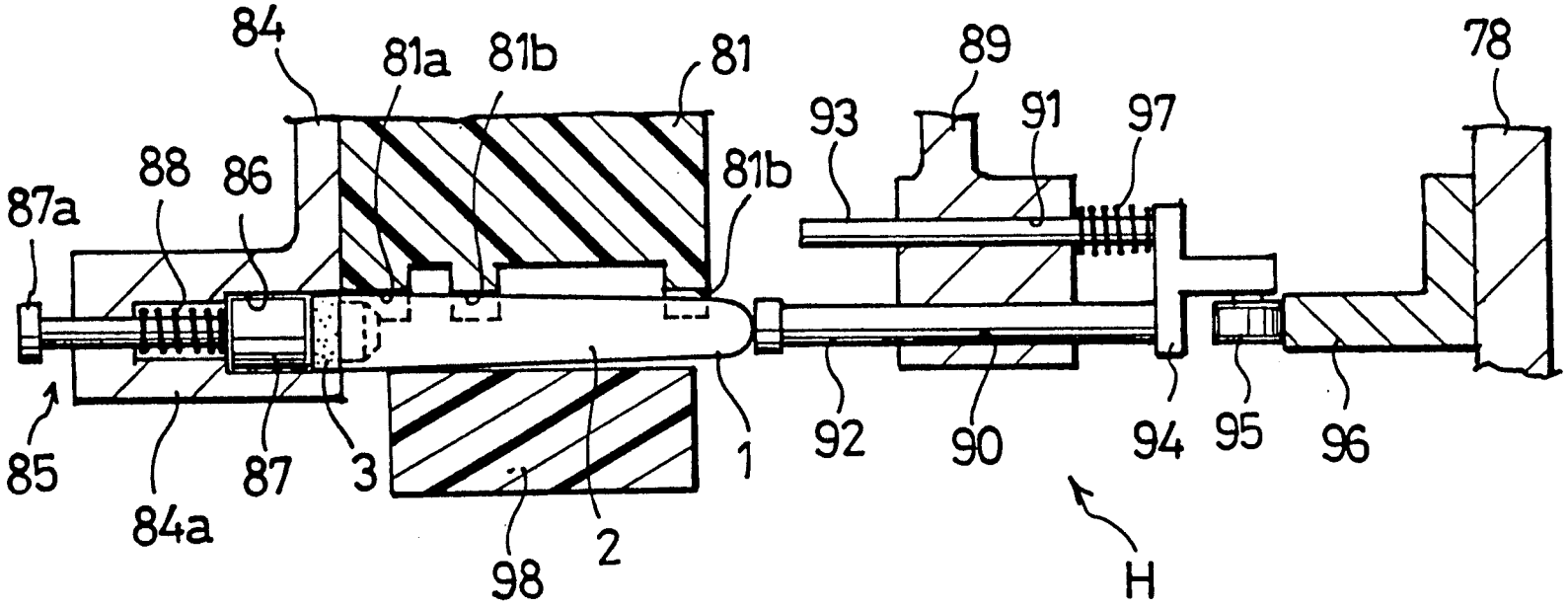
FIG. 18 is an enlarged view in section taken along the line Z—Z in FIG. 16.

The evacuating-closing device H is shown in FIG. 10, and the main components thereof in FIGS. 16 to 18.

The device H is adapted to evacuate the tubular container 1 to a vacuum after the serum separating agent b has been injected into the container with the blood coagulant a applied thereto, and to close the opening portion 1*a* of the container with the stopper 3. The device H has a vacuum housing 78 connected to pressure reducing means 107 by an air discharge pipe 77. Rotatably supported inside the vacuum housing 78 are an inlet seal turret 79, first intermediate wheel 80, center turret 81, second intermediate wheel 82 and outlet seal turret 83.

The inlet seal turret 79 is provided inside an inlet opening 78*a* formed in an upper portion of the housing 78. The turret 79 is in the form of a hollow cylinder and provided in the outer periphery thereof with a plurality of holding grooves 79*a* extending axially thereof and arranged at equal spacings. Although not shown, a seal member is provided over the portions between the peripheral holding grooves 79*a* of the inlet seal turret 79 and opposite end faces thereof, whereby the inlet opening portion of the housing 78 around the inlet seal turret 79 is sealed off. The outlet seal turret 83 is provided inside an outlet opening 78*b* formed in a front upper portion of the housing 78. The turret 83 is also in the form of a hollow cylinder and provided in the outer periphery thereof with a plurality of axial holding grooves 83*a* at equal spacings. Although not shown, a seal member is provided over the portions between the peripheral holding grooves 83*a* of the outlet seal turret 83 and opposite end faces thereof, whereby the outlet opening portion of the housing 78 around the outlet seal turret 83 is sealed off. In this way, the interior of the housing 78 is separated from the atmospheric air by the inlet and outlet seal turrets 79, 83, and is held in a predetermined vacuum by the pressure reducing means 107.

The center turret 81 is disposed inside the housing 78 centrally thereof. The first intermediate wheel 80 is disposed between the center turret 81 and the inlet seal turret 79, and the second intermediate wheel 82 between the center turret 81 and the outlet turret 83.

The first intermediate wheel 80 has four rows of teeth arranged from left to right on its outer periphery. The two rows of teeth at left which are relatively close to each other are formed with stopper holding grooves 80*a*, and the two rows of teeth at right which are relatively away from each other are formed with tubular container holding grooves 80*b*.

The second intermediate wheel 82 is in the form of a hollow cylinder and provided in its outer periphery with a plurality of vacuum collecting tube holding grooves 82*a*.

The center turret 81 has three rows of teeth arranged from left to right on its outer periphery. The row of teeth at the left end has a plurality of stopper holding grooves 81*a*, and the other two rows of teeth toward the right have tubular container holding grooves 81*b*.

A first rotary disk 84 is fixed to the left end of the center turret 81 so as to be rotatable therewith. Tubular portions 84*a* formed on the outer peripheral portion of the disk 84 in corresponding relation to the respective stopper holding grooves 81*a* each have a shock absorber 85. The shock absorber 85 comprises a spindle 87 inserted in a stepped bore 86 of the tubular portion 84*a*, and a coiled compression spring 88 for biasing the spindle rightward. A stopper 87*a* is integral with the left end of the spindle 87 projecting out beyond the tubular portion 84*a*. The spindle 87 is usually held by the stopper 87*a* in a right limit position where the spindle right end is flush with the right end face of the tubular portion 84*a*. The spindle 87 is movable to a left limit position which is slightly leftward from this position.

A second rotary disk 89 is provided at the right side of the center turret 81 so as to be rotatable therewith. In corresponding relation with the respective tubular container holding grooves 81*b*, pin inserting bores 90 extend through the outer peripheral portion of the disk 89 axially thereof. A guide bore 91 positioned radially inwardly of each of the bores 90 extends through the disk peripheral portion axially thereof. A pusher pin 92 and a guide pin 93 are inserted in the inserting bore 90 and the guide bore 91, respectively, so as to be movable axially of the disk 89. The right ends of these pins 92, 93 are interconnected by a connecting member 94 carrying a cam follower 95. The rotation of the second rotary disk 89 moves the cam follower 95 on an annular cam 96 provided on the inner surface of the housing 78. A coiled compression spring 97 is provided around the guide pin 93 between the second rotary disk 89 and the connecting member 94 for biasing the pins 92, 93 and the connecting member 94 rightward to press the cam follower 95 against the cam 96. At an upper side location where the center turret 81 is adjacent to the two intermediate wheels 80, 82, the cam 96 has the lowest height to bring the pusher pin 92 to the most rightward position. At a lower side location remotest from these intermediate wheels, the cam 96 has the greatest height to move the pusher pin 92 to the most leftward position.

Provided around the center turret 81 and the two intermediate wheels 80, 82 is a guide member 98 which is cooperative with these members for holding tubular containers 1 and stoppers 3.

A stopper feed wheel 99 is provided above the front portion of the inlet opening 78*a* of the housing 78, as opposed to the left portions of the holding grooves 79*a* of the inlet seal turret 79. The feed wheel 99 is formed in its outer periphery with a plurality of stopper holding grooves 99*a* arranged at equal spacings. A stopper chute 100 has a lower end opposed to the upper portion of the stopper feed wheel 99. Although not shown, the stopper chute 100 has an upper end connected to a hopper or the like for storing stoppers 3.

A tubular container feed wheel 101 is disposed above the rear portion of the inlet opening 78*a* of the housing so as to be opposed to the right portions of the holding grooves 79*a* of the inlet seal turret 79. The feed wheel 101 is formed in its outer periphery with a plurality of tubular container holding grooves 101*a* at equal spacings. A tubular container chute 102 has a lower end opposed to the upper portion of the tubular container feed wheel 101 and has an upper end opposed to the front end of the tubular container conveyor 72 included in the container withdrawing device G.

The stopper feed wheel 99, tubular container feed wheel 101, inlet seal turret 79, first intermediate wheel 80, center turret 81, second intermediate wheel 82 and outlet seal turret 83 are driven by suitable drive means in operative relation with one another in the respective directions of arrows in FIG. 10, each intermittently by one pitch of its holding grooves at a time.

A vacuum blood collecting tube delivery conveyor 103 is provided at the outlet opening 78b of the housing 78. The conveyor 103 has an endless belt 104 driven by a pair of front and rear pulleys. The belt 104 has on its outer surface a plurality of projection plates 105 arranged side by side longitudinally of the conveyor at a spacing approximately equal to the outside diameter of the tubular container 1.

Next, a description will be given of the operation of the above apparatus, i.e., an exemplary process for producing vacuum blood collecting tubes according to the present invention.

Tubular containers 1 are placed into the hopper 4 of the storage-feeder A, contained therein as randomly positioned with respect to various directions, placed from the lowermost position successively onto the belt 11 of the delivery conveyor 5 between the projection plates 14 and delivered to the chute 13 via the lifter 6. At this time, the tubular containers 1 in the vicinity of the hopper front wall 4a are dividedly guided rightward and leftward by the ridgeline 15a of the guide member 15 on the inner surface of the front wall 4a, further slide along the opposed slopes 15b downward obliquely rearward, and are therefore placed as positioned horizontally onto the belt 11 in the rear of the discharge opening 12 at the lower end of the front wall 4a. This mode of delivery will not permit tubular containers 1 to stand upright at the location of the hopper discharge opening 12 and diminishes the likelihood of tubular containers 1 blocking in the rear of the opening 12, ensuring smooth discharge of containers 1 by the operation of the delivery conveyor 5.

The tubular containers 1 fed to the lifter 6 via the chute 13 are successively sent forward by the upward and downward movement of the three lift members 17a, 17b, 17c of the lifter 6 and placed horizontally on the belt 18 of the lift conveyor 7 between the projection plates 19 thereof. These containers 1 are then sent upward by the operation of the lift conveyor 7, allowed to fall between the opposed portions of the pair of ropes 21a, 21b of the rope conveyor 8 through the space between the pair of guide plates 20a, 20b and held upright between the rope opposed portions with their opening ends up. The tubular containers 1 as fed to the lift conveyor 7 between the projection plates 19 are randomly positioned with the opening portions 1a oriented rightward or leftward and then allowed to fall onto the rope conveyor 8 through the space between the guide plates 20a, 20b also as randomly oriented, whereas since the sidewise spacing between the opposed portions of the ropes 21a, 21b is larger than the outside diameter of the container bottom portion 1b but smaller than that of the opening portion 1a, the bottom portions 1b pass between the ropes 21a, 21b to project therebelow, with the opening portions 1a remaining on the upper side of the ropes 21a, 21b no matter in what posture the containers 1 fall between the ropes 21a, 21b. The tubular containers 1 are then sent to the space between the pair of twist belts 24a, 24b of the twist conveyor 9 while being held in an upright position in which each container 1 is held between the ropes 21a, 21b at an upward intermediate portion thereof, with the opening portion 1a up and with the bottom portion 1b down.

The tubular containers 1 are sent forward as held between the twist belts 24a, 24b. In the meantime, the containers 1 are shifted from the upright position with the opening portion 1a up uniformly to a horizontal position in which the opening 1a is oriented leftward by the twist of the belts 24a, 24b. The containers 1 are thereafter fed to the upper end of the wave-shaped chute 10.

The tubular containers 1 supplied to the chute 10 descent between the pair of wave-shaped guide plates 25a, 25b while being held substantially in the horizontal position, and are fed one by one to the respective holding grooves 26a of the first star wheel 26 of the pinhole checker B by the operation of the above-mentioned unillustrated movable stopper.

Suppose the guide plates 25a, 25b of the chute 10 are each in the form of a flat plate. When tubular containers 1, which are tapered, are fed in a horizontal position to the space between the guide plates and stacked up linearly, a sectorial stack will be formed in which the diametrically large opening portions 1a of the adjacent containers 1 contact each other with the diametrically small bottom portions 1b in contact with each other, and the containers at a higher level are positioned obliquely. Consequently, a large quantity of containers 1 can not be stacked up by the chute 1.

With the wave-shaped chute 10 of the present embodiment, on the other hand, the tapered tubular containers 1 descend along the wave form of the guide plates 25a, 25b and are stopped from descending by the contact of the opening portion 1a of each container 1 with the opening portion 1a of the preceding container 1. At this time, the diametrically small bottom portion 1b of the container 1 also tends to descend to come into contact with the bottom portion 1b of the preceding container 1 but is nevertheless prevented from descending since the guide plates 25a, 25b have no substantially straight portion. As a result, each tubular container 1 descends with the descent of the preceding container 1 while being held in a substantially horizontal position.

The tubular containers 1 fed to the first star wheel 26 of the pinhole checker B are thereby revolved through a predetermined angle and thereafter transferred to the respective holding grooves 27a of the second star wheel 27. While each container 1 is being revolved as held on the first star wheel 26, the container 1 has its interior cleaned and its bottom portion 1b checked for pinholes in the following manner.

When the container 1 is transferred from the chute 10 to one of the holding grooves 26a of the first star wheel 26, the right end of the tubular electrode 31 corresponding to this groove 26a is leftwardly away from the container 1. With the rotation of the wheel 26, the electrode 31 gradually moves rightward. Upon the electrode right end entering the container 1, the change-over valve is switched, connecting the electrode 31 to the air supply side of the air supply-discharge device, which in turn forces out air from the right end of the electrode 31, whereby dust or the like remaining in the interior of the tubular container 1 is entrained in the air and discharged from the container 1. With a further rotation of the first star wheel 26, the pressing member 32 comes into contact with the opening portion 1a of the tubular container 1, pressing the bottom portion 1b thereof against the guide member 35 to position the container 1 in place. After the pressing member 32 has come into contact with the container 1, the electrode 31 along further advances into the container 1 by compressing the spring 33.

By the time the container 1 is brought to the position of the electrode brush 37, the electrode 31 is advanced to a predetermined checking position in which the electrode end is located inside the bottom portion 1b as seen in FIG. 11. In this state, a high voltage is applied across the electrode brush 37 and the electrode 31 by the power supply. If passage of current between the brush 37 and the electrode 31 is detected at this time, this indicates that the bottom portion 1*b* has a pinhole, whereas if otherwise, the bottom portion 1*b* is free from any pinhole. Thus, the container can be checked for pinholes by detecting the passage of current.

On completion of pinhole checking, rotation of the first star wheel 26 moves the electrode 31 and the pressing member 32 leftward away from the tubular container 1. In this state, the container 1 is transferred from the holding groove 26*a* of the first star wheel 26 to one of the holding grooves 27*a* of the second star wheel 27.

The tubular containers 1 thus transferred to the second star wheel 27 are revolved thereby toward the third star wheel 28. The rejects with a pinhole are discharged from the apparatus by being forced away by a jet of compressed air from the aforementioned unillustrated reject discharge nozzle when to be transferred from the second star wheel 27 to the third star wheel 28. The acceptable containers free from any pinhole only are transferred from the wheel grooves 27*a* to the holding grooves 28*a* of the third star wheel 28, from which the containers are supplied to the screw feeder 40 of the blood coagulant sprayer C.

When the tubular container 1 is fed as horizontally positioned to the screw feeder 40 of the sprayer C, the container 1 fits in the screw furrows 43*a*, 43*b* of the pair of screw rods 42*a*, 42*b* and is so inclined that the bottom portion 1*b* on the right side is at a lower level due to the difference between the screw rods in outside diameter. The bottom portion 1*b* comes into contact with the guide member 38, whereby the container is restrained in position with respect to the rightward direction. The container 1 is sent forward by the rotation of the screw rods 42*a*, 42*b* at a speed according to the pitch of the screw furrows 43*a*, 43*b*. Since the furrow pitch is so determined as to gradually increase from the rear end of each rod to the midportion thereof, the tubular containers 1 supplied successively from the pinhole checker B are transported in such manner that each container approaches the preceding container before reaching the midportion of the screw feeder 40. The adjacent containers 1 are thereafter translated substantially in contact with each other.

On the other hand, the blood coagulant b is sprayed rightward from the nozzle 41 at the left side of the midportion of the screw feeder 40 onto the inner surface of the tubular container 1 through the opening portion 1*a* thereof oriented toward the left. At this time, the container 1 is transported forward as fitted in the screw furrows 43*a*, 43*b* while being rotated by frictional contact with the screw rods 42*a*, 42*b*, so that the agent b can be uniformly applied to the inner surface of the peripheral wall of the container 1.

The tubular containers 1 each having the blood coagulant applied to the inner surface in this way are so transported forward that each container 1 is positioned at a gradully increasing distance from the preceding container 1 in accordance with the furrow pitch gradually increasing from the screw feeder midportion to the feeder front end. The containers are fed to the dryer D.

The tubular containers 1 supplied to the dryer D are transported as held by the five star wheels 45, 46, 47, 48, 49 successively. The blood coagulant applied is dried during the transport. The dried containers 1 are supplied from the fifth star wheel 49 to the wave-shaped chute 50 one by one. The containers 1 supplied to the chute 50 are lowered while being held in a horizontal position in the same manner as alreay described and fed one by one to the aligning conveyor 52 between the projection plates 54*a*, 54*b*.

The tubular containers 1 fed to the aligning conveyor 52 are sent forward intermittently, eight containers at a time. When eight containers 1 are arranged at the left side of the guide unit 57, two transport containers 51 are positioned immediately below the guide unit 57. In this state, the pusher 59 of the tubular container erecting device E is moved to the right limit position and thereafter retracted to the left limit position. When moved rightward, the pusher 59 pushes the eight tubular containers 1 by striking contact with the upper parts of opening portions 1*a* thereof, whereby the eight containers 1 are passed through the respective spaces defined by the guide plates 57*a*, 57*b* and the partitions 57*c* of the guide unit 57, turned to an upright position with the bottom portion 1*b* down and inserted into the respective bores 56 of the two transport containers 51. The two transport containers 51 each having the four tubular containers 1 inserted therein in this way are sent forward by the feed conveyor 55.

When the two transport containers 51 each carrying the four upright tubular containers 1 therein are brought to the location of the serum separating agent injector F, the movable members 64 of the two transport container transfer devices 63 rise to fit the transport containers 51 in the left grooves 64*a*, lift the containers 51, move rightward and thereafter descend. At this time the supports 62 are in their lowered position. The transport containers 51 held in the left grooves 64*a* are positioned immediately above the supports 62 by the rightward movement of the movable members 64. The transport containers 51 held in the left grooves 64*a* are fitted into the grooves 62*a* of the supports 62 by the descent of the movable members 64 and held by the supports 62, whereupon the movable members 64 move away from the transport containers 51 downward. The movable members 64 having transferred the transport containers 51 to the supports 62 in this way move leftward and stop.

The supports 62 rise with the transport containers 51 thus held thereby, whereby the nozzles 69 of the nozzle cases 67 are inserted into the respective tubular containers 1, and the 0-ring on the bottom of the peripheral wall 67*a* of each nozzle case 67 is brought into contact with the peripheral portion upper surface 51*a* of each transport container 51 as shown in FIG. 15. Consequently, the space defined by the transport container 51 and the nozzle case 67 is separated off from the outside. The pressure reducing means 106 is thereafter operated to remove air from the space through the air supply-discharge port 70. When the space is evacuated to a predetermined vacuum, the change-over valve in the change-over valve unit 66 is switched, causing the nozzles 69 to inject the serum separating agent b into the bottom portions 1*b* of the tubular containers 1. On completion of injection of the agent b, the pressure reducing means discontinues suction to permit the port 70 to communicate with the atmosphere, and the supports 62 are lowered.

The serum separating agent b to be injected into the tubular containers 1 is a mixture of chlorinated polybutene, epoxydized soybean oil, inorganic filler, etc., has a viscosity of about 300,000 cps at 25° C. and is highly viscous. Accordingly, if the tubular containers 1 are lowered relative to the nozzles 69 by lowering the supports 62 after the injection of the serum separating agent b into the containers 1, the agent b remaining within the tip of each nozzle 69 stretches in the shape of unbroken thread, hence so-called cobwebbing.

To preclude the cobwebbing of the serum separating agent, the injector F is adapted to inject the agent b, for example, in the following manner.

A specified amount of agent b is injected into each tubular container 1 with the supports 62 in the raised position, and the supports 62 are thereafter slightly lowered at a low speed and stopped. A predetermined period of time after the stopping of the supports 62, the supports 62 are lowered at a higher speed while applying back suction to the agent b within the nozzles 69. The thread of agent b can be gradually thinned and eventually broken to eliminate cobwebbing by moving the tubular containers 1 a very small distance at a low speed after the injection of agent b, stopping the containers 1 for the predetermined period of time and thereafter moving the containers 1 at a higher speed with application of back suction in this way.

When the supports 62 are lowered after the injection of the serum separating agent b, the movable members 64 are raised, moved rightward, lowered and moved leftward again. When the movable members 64 are raised, the transport containers 51 carrying the tubular containers 1 containing the injected agent b are fitted into the right grooves **64*b* of the movable members 64 and lifted off the supports 62. At the same time, the next two transport containers 51 are fitted into the left grooves 64*a* of the movable members 64 as already stated and lifted off the feed conveyor 55. The movable members 64 are moved rightward in this state, whereby the transport containers 51 held in the right grooves 64*b* are positioned immediately above the delivery conveyor 60, and the transport containers 51 held in the left grooves 64*b* are positioned immediately above the supports 62 lowered as stated above. The movable members 64, when subsequently lowered, transfer the preceding transport containers 51 from the right grooves 64*b* to the delivery conveyor 60 and the following transport containers 51 from the left grooves 64*a* to the supports 62. Through repetitions of the above operation, transport containers 51 are transferred from the feed conveyor 55 to the supports 62, two containers at a time, the serum separating agent is injected into the tubular containers 1 held by the supports, and the transport containers 51 carrying the containers 1 with the agent injected therein are transferred from the supports 62 to the delivery conveyor 60**.

With the injector F described above, the space defined by each transport container 51 and each nozzle case 67 is held in the predetermined vacuum, whereby the interior of the tubular containers 1 inserted in the transport container 51 is also held in a vacuum, consequently ensuring injection of the serum separating agent in the absence of air. Further instead of holding the tubular containers 1 individually in vacuo, the space defined by the nozzle case 67 and the transport container 51 having a plurality of tubular containers 1 inserted therein is held in a vacuum, so that the interior of the plurality of containers 1 can be held in vacuo at the same time by the single pressure reducing means 106. The tubular container inserting bores 56 are formed in one surface of the transport container 51 of solid structure, the bored surface is pressed against the nozzle case 67, and only the space formed as separated from the outside air is evacuated. This minimizes the space to be evacuated, separates off the space from the atmosphere effectively and serves to produce the specified vacuum within a short period of time without using pressure reducing means of increased capacity.

The transport containers 51 transferred to the feed conveyor 60 after the injection of serum separating agent into the tubular containers 1 therein are intermittently sent forward, two containers 51 at a time. When two transport containers 51 are brought to immediately below the tubular container withdrawing device G, the movable member 75 descends with the grippers 75 facing downward, whereupon the grippers 76 close, each gripping four tubular containers. With eight containers 1 thus held by the grippers 76, the movable member 76 rises to withdraw the tubular containers 1 from the transport containers 51, pivotally moves to direct the grippers 76 rightward and further moves rightward, whereby the eight containers 1 held by the grippers 76 are placed, each as horizontally positioned with the bottom portion **1*b* at right, onto the belt 73 of the tubular container conveyor 72 between the projection plates 74 thereof. The grippers 76 therefore open, releasing the tubular containers 1, whereupon the aforementioned unillustrated pusher pushes the tubular containers 1 rightward on the belt 73**.

After the tubular containers 1 have been thus transferred onto the container conveyor 72, the grippers 76 retract, the movable member 75 thereafter moves leftward and further pivotally moves to direct the grippers 76 downward, and the device G is made ready for withdrawing the tubular containers 1 from the next two transport containers 51.

On the other hand, the two transport containers 51 on the delivery conveyor 60 emptied of the tubular containers 1 by the withdrawing device G are returned to the feed conveyor 55 by an unillustrated suitable return conveyor for reuse.

The tubular containers 1 transferred to the container conveyor 72 are sent forward intermittently, eight containers 1 at a time, by the conveyor 72 which is driven intermittently, and are fed one by one to the tubular container chute 102 of the evacuating-closing device H.

The tubular containers 1 within the chute 102 are supplied one by one to the holding grooves **101*a* of the tubular container feed wheel 101, and stoppers 3 in the stopper chute 100 are fed one by one to the holding grooves 99*a* of the stopper feed wheel 99. The container feed wheel 101 and the stopper feed wheel 99 in rotation feed these containers 1 and stoppers 3, respectively, to the holding grooves 79*a* of the inlet seal turret 79 one by one. At this time, each container 1 and each stopper 3 are held in the holding groove 79*a* with the container opening portion 1*a* opposed to, and spaced by a given distance from, the stopper press-fit portion 3*a***.

The tubular container 1 and the stopper 3 fed to the inlet seal turret 79 are guided as separated off from the outside air into the housing 78 by the rotation of the turret 79 and delivered to the center turret 81 by way of the first intermediate wheel 80.

The container 1 and the stopper 3 delivered to the center turret 81 are held in the container holding grooves **81*b* and the stopper holding groove 81*a*, respectively, as shown in FIG. 17. When the container 1 and the stopper 3 are delivered from the first intermediate wheel 80 to the center turret 81, the corresponding pusher pin 92 is in a rightwardly moved position away from the tubular container 1 as seen in FIG. 17. With the rotation of the center turret 81, to cam 96 acts to move the pusher pin 92 leftward against the spring 97, pushing the container 1 toward the stopper 3. A further rotation of the center turret 81 brings the container 1 into contact with the stopper 3, thereafter causing the pusher pin 92 to push both the container 1 and the stopper 3 leftward, whereby the stopper 3 is fitted into the stepped bore 86 of the tubular portion 84***a* while pushing the spindle 87 of the shock absorber 85. However, the stepped portion in the bore 86 stops the spindle 87 to prevent a further movement of the stopper 3. Consequently, the container 1 pushed permits the press-fit portion 3*a* of the stopper 3 to be fitted into the container opening portion 1*a*. At this time, the portion of the stopper 3 other than its press-fit portion 3*a* is fitted in the bore 86 substantially in conformity therewith, so that the stopper 3 is in alignment with the container 1 and can be properly fitted into the container 1.

After the container 1 has been closed with the stopper 3 in this way, the cam 96 and the spring 97 act to move the pusher pin 92 rightward. The spring 88 of the shock absorber 85 thereafter acts to force out the stopper 3 from the stepped bore 86. The tubular container 1 having the stopper 3 fitted therein, i.e., a completed vacuum blood collecting tube 2, is thus removed from the bore 86 and held in the holding grooves 81*a*, 81*b*.

Vacuum blood collecting tubes 2 are prepared in this way. These tubes 2 are sent from the center turret 81 to the outlet seal turret 83 via the second intermediate wheel 82. While being separated off from the outside air, the tubes 2 are delivered from the outlet opening 78*b* of the housing 78 to the delivery conveyor 103 by the outlet seal turret 83.

The apparatus and the process embodying the invention for producing vacuum blood collecting tubes are not limited to those of the above embodiments but can be modified suitably within the scope of the invention.

What is claimed is:

1. An apparatus for producing vacuum blood collecting tubes comprising a pinhole checker for checking the bottom portion of each of bottomed tubular containers for pinholes, a sprayer for spraying a blood coagulant to the inner surface of the tubular container, an injector for injecting a serum separating agent into the tubular container, an evacuating-closing device for evacuating the interior of the tubular container and applying a stopper to an opening of the tubular container, and container transport means between these components of the apparatus, the apparatus being characterized in that the injector comprises a transport container of solid structure formed in a surface thereof with a plurality of bores for inserting tubular containers individually thereinto, a nozzle case having a plurality of serum separating agent injecting nozzles insertable into tubular containers individually, means for moving the transport container and the nozzle case relative to each other to press the bored surface of the transport container and a nozzle providing surface of the nozzle case against each other, and means for reducing the pressure of a space defined by the pressed surfaces f the transport container and the nozzle case.

2. A process for producing vacuum blood collecting tubes characterized in that the process comprises the steps of:

checking the bottom portions of bottomed tubular containers for pinholes while holding the tubular containers approximately horizontal, spraying a blood coagulant to the inner surface of the tubular containers while holding the containers approximately horizontal, inserting the tubular containers having the blood coagulant sprayed to their inner surfaces individually into a plurality of bores formed in a surface of a transport container of solid structure, pressing a nozzle case having a plurality of serum separating agent injecting nozzles against the bored surface of the transport container relative thereto and injecting a serum separating agent into the tubular containers from the respective nozzles while reducing the pressure of a space defined by the nozzle case and the transport container, and evacuating the interior of the tubular containers and applying a stopper to an opening of each of the tubular containers.

* * * * *